US009402483B2

(12) United States Patent
Kaalberg

(10) Patent No.: US 9,402,483 B2
(45) Date of Patent: Aug. 2, 2016

(54) YOGA MAT CLIP

(71) Applicant: Lindsey Kaalberg, San Francisco, CA (US)

(72) Inventor: Lindsey Kaalberg, San Francisco, CA (US)

( * ) Notice: Subject to any disclaimer, the term of this patent is extended or adjusted under 35 U.S.C. 154(b) by 0 days.

(21) Appl. No.: 14/285,924

(22) Filed: May 23, 2014

(65) Prior Publication Data

US 2014/0345089 A1 Nov. 27, 2014

Related U.S. Application Data

(60) Provisional application No. 61/827,185, filed on May 24, 2013.

(51) Int. Cl.
*A47C 21/02* (2006.01)

(52) U.S. Cl.
CPC ..... *A47C 21/022* (2013.01); *A63B 21/4037* (2015.10); *Y10T 24/23* (2015.01); *Y10T 24/44017* (2015.01)

(58) Field of Classification Search
CPC A47C 21/022; Y10T 24/23; Y10T 24/44017; A63B 21/00; A63B 21/1473; A63B 21/4037
See application file for complete search history.

(56) References Cited

U.S. PATENT DOCUMENTS

| | | | | | |
|---|---|---|---|---|---|
| 555,746 | A | * | 3/1896 | Snyder | 24/538 |
| 734,089 | A | * | 7/1903 | Pilkington | 24/538 |
| 748,423 | A | * | 12/1903 | Schaffner | 24/538 |
| 763,014 | A | * | 6/1904 | Neider | 24/457 |
| 800,499 | A | * | 9/1905 | Shelander | 24/538 |
| 1,472,471 | A | * | 10/1923 | Hope | 24/457 |
| 2,277,044 | A | * | 3/1942 | Freysinger | 24/496 |
| 5,249,336 | A | * | 10/1993 | Miller | 24/67.5 |
| 5,640,742 | A | * | 6/1997 | White et al. | 24/3.12 |
| 6,453,518 | B1 | * | 9/2002 | Adams et al. | 24/67.9 |
| 2010/0031476 | A1 | * | 2/2010 | Coldiron | 24/3.12 |

* cited by examiner

*Primary Examiner* — Robert J Sandy
*Assistant Examiner* — Louis Mercado
(74) *Attorney, Agent, or Firm* — Brett D. Papendick; Shuttleworth & Ingersoll, PLC

(57) ABSTRACT

A clip for a yoga mat which secures a towel to the mat. The clip has a frame portion along with a cam lever or actuator. A user of the device rotates the cam lever about an axis from a first position to a second position. As the cam lever is rotated toward the second position, a portion of the cam lever makes contact with a movable portion of the frame. The cam lever forces the movable portion from a top location toward a bottom location which shortens a space between two members of the clip. The towel and mat are secured when the device is in the second position.

14 Claims, 4 Drawing Sheets

YOGA MAT CLIP

CROSS-REFERENCE TO RELATED APPLICATIONS

The present application claims priority to provisional patent application 61/827,185 which was filed on May 24, 2013, and is hereby expressly incorporated by reference in its entirety.

BACKGROUND

During exercise activities, in particular Yoga, the need arises for both a mat and a towel for comfort, allowing a user to maintain a desired position during exercise, and absorbing liquids including perspiration. The mat is typically padded to reduce the impact on an individual's muscles and joints. The towel is placed over the mat and serves to absorb sweat and prevent the individual from slipping on the mat. Perspiration and sweat can become an even greater problem during Hot Yoga.

While participating in group Yoga activities or solo Yoga activities, the towel can become displaced from its original preferred position. The Yoga participant must then reposition the towel. The act of repositioning the towel causes the Yoga participant to fall behind in group activities, miss certain Yoga poses, increase the length of the workout, and potentially injure the participant.

It is an object of the invention to provide a device which holds a towel on a mat.

It is a further object of the invention to provide a device which reduces the number of times a towel has to be repositioned during exercise, particularly during Yoga.

SUMMARY OF THE INVENTION

A clip in an open position slides over an end portion of a mat and a towel. After arranging the towel in a chosen location relative to the mat, a cam lever or actuator is actuated toward a closed position. As the cam lever is directed toward the closed position, a portion of the clip eventually reaches full compression. The cam lever then is forced in an over center position to lock the clip, towel and mat in place. The process is reversed to unsecure the towel and mat from the clip.

DETAILED DESCRIPTION

Figure 1:
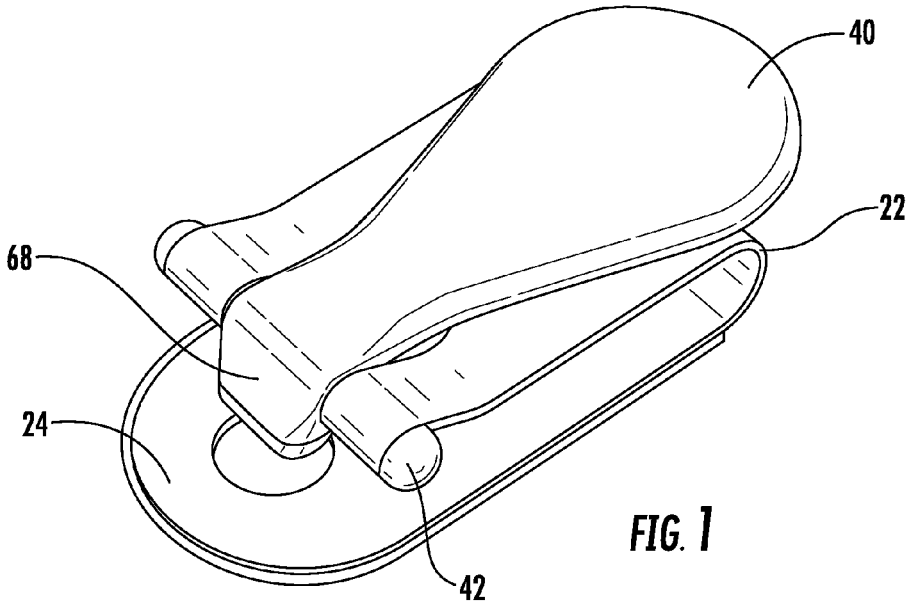
FIG. 1 is a perspective view of the invention in the locked position.

Now referring to the drawings, FIGS. 1-8 show a clip 20 comprising a frame 22 and an actuator 40. The frame 22 further comprises a top member 23 and a bottom member 24. The top member 23 and bottom member 24 are separated by a first distance 36. Preferably the top member 23 is connected to the bottom member 24 through an intermediate member 26. The top member 23, bottom member 24 and intermediate member 26 can be made of the same material and form one continuous part. In the preferred embodiment the clip 20 is made of metal and is a spring steel. The top member 23 further comprises a plurality of arms 30 and 32 and a movable member 34.

The actuator 40 is a cam lever comprising a first end 62, a second end 64 and a pair of opposing rods 42. It is to be understood that one rod 42 can be utilized with a first end and second end protruding from the actuator 40. In the preferred embodiment, the actuator 40 is generally L-shaped. The actuator 40 comprises a long arm 66 and a short arm 68. The short arm 68 is substantially perpendicular to the long arm 66. The rods 42 extend from the actuator 40 at a point between the first end 62 and second end 64, preferably at the point where the short arm 68 and long arm 66 connect. The rods 42 are secured by the arms 30 and 32. The actuator 40 is rotatable about an axis of a center of the rods 42.

Figure 2:
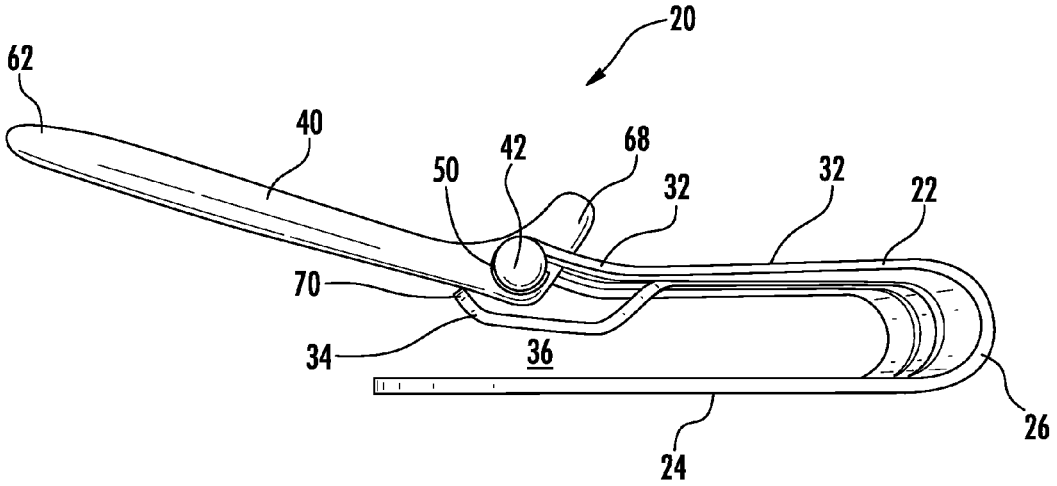
FIG. 2 is a side view of the invention in the open position.
Figure 3:
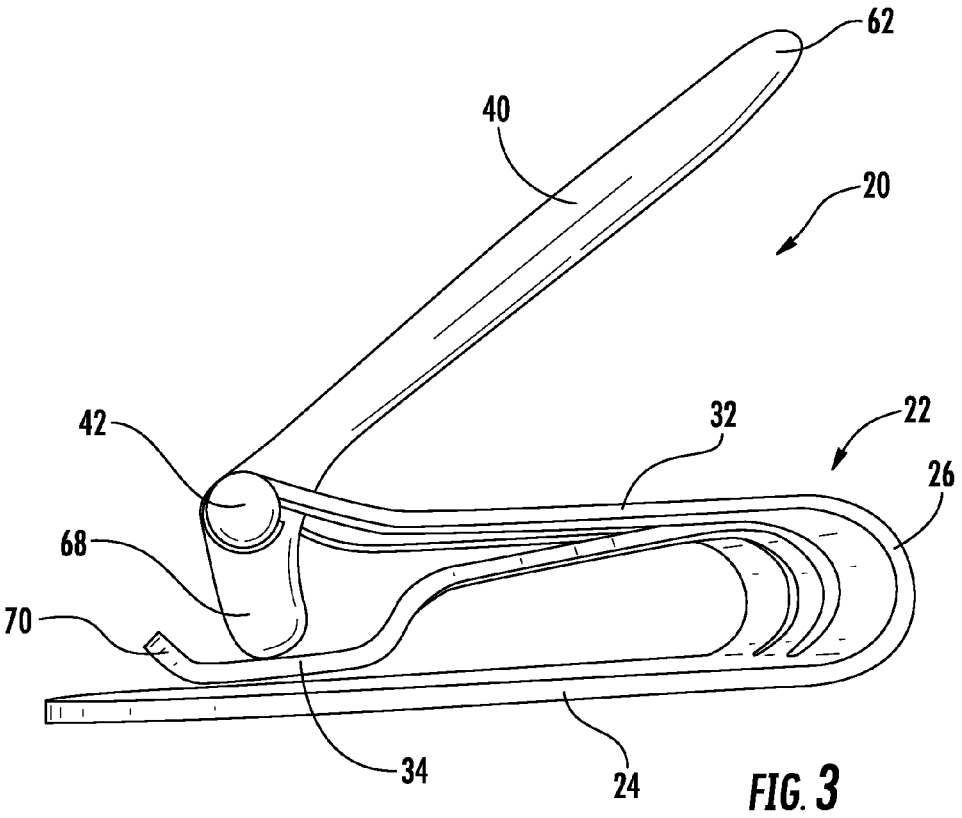
FIG. 3 is a side view of the invention at full compression.
Figure 4:
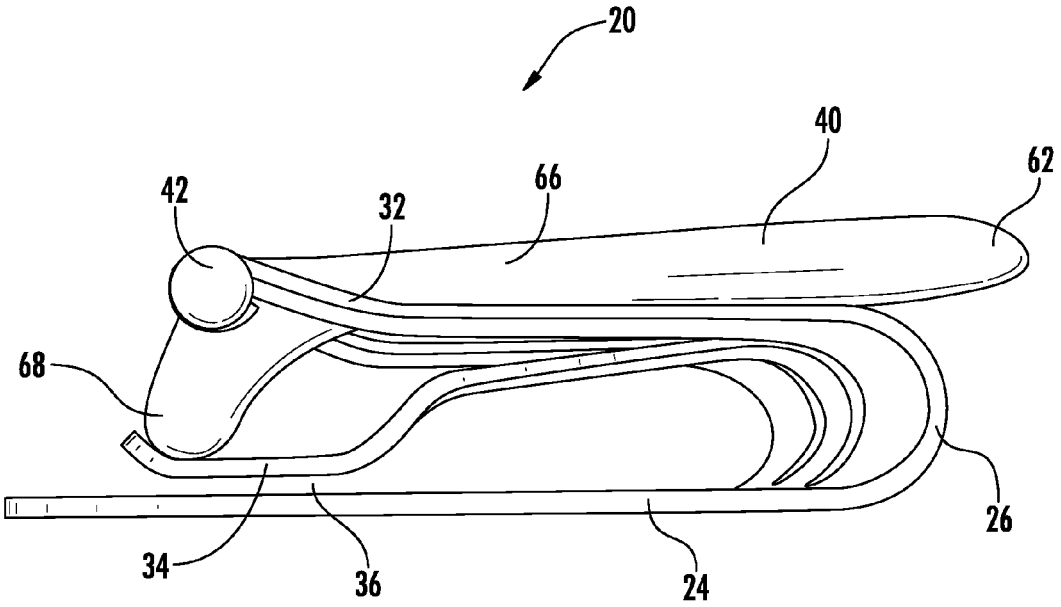
FIG. 4 is a side view of the invention in the locked position.
Figure 5:
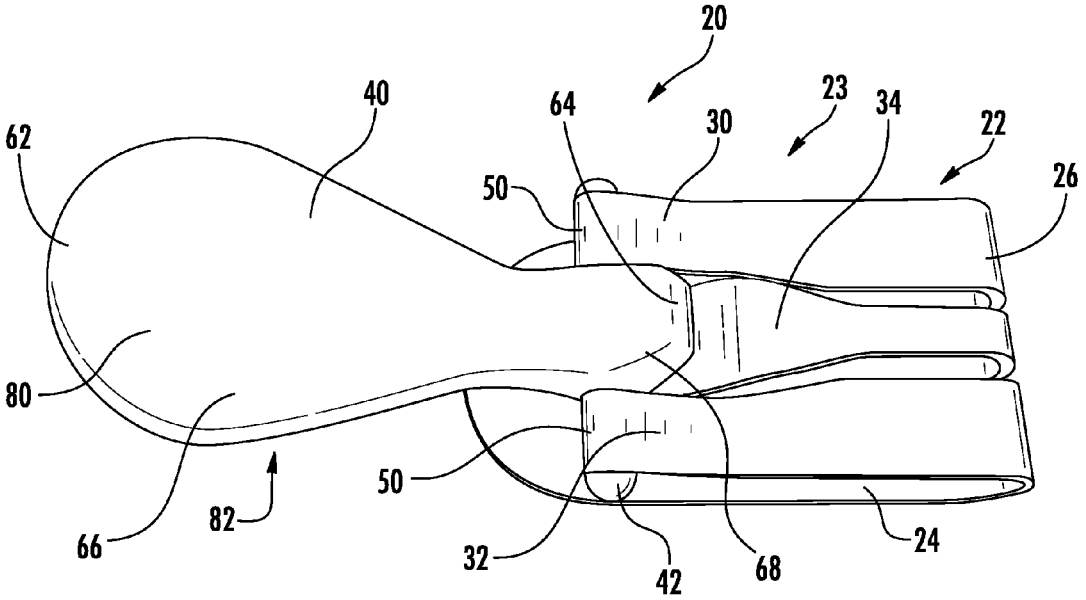
FIG. 5 is a perspective view of the invention in the unlocked position.
Figure 6:
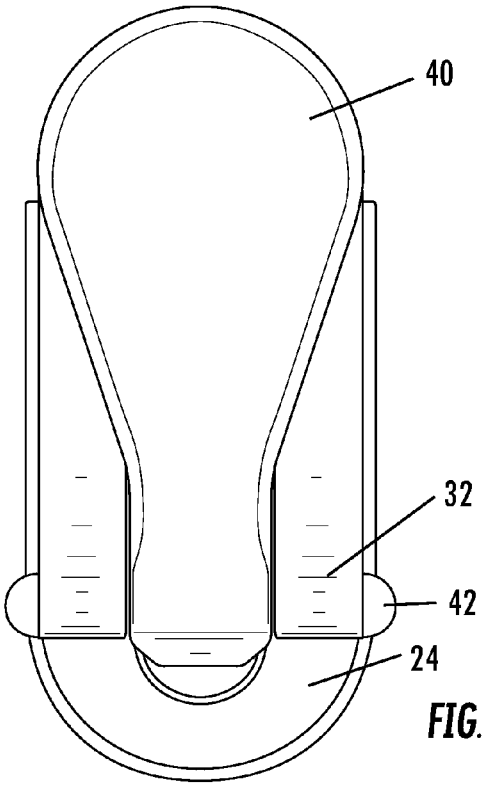
FIG. 6 is a top view of the invention.

Referring specifically to FIGS. 2-4, the clip 20 can go from a first position which is an open position to a second position which is a closed position, as well as any position in between the first and second position. In the first position, the movable portion 34 of the top member 23 is the distance 36 from the bottom member 24. The actuator 40 also has a first position in the open position. As the first end 62 is moved toward the top member 23 as shown in FIG. 3, the short arm 68 of the actuator 40 forces the movable member 34 downward toward the bottom member 24. The actuator 40 is rotatable around a longitudinal axis of the rods 42 as the actuator 40 moves between the first position and second position. The downward movement shortens the distance 36 between the top member 23 and bottom member 24. Accordingly, any object, specifically the towel and mat between the movable member 34 and bottom member 24 begin to be secured as the actuator 40 is moved toward the second position.

At some point between the first position and the second position, a portion of the clip 20 eventually reaches full compression. At the point of full compression, the downward movement of the movable portion 34 ceases. As the actuator 40 continues its rotation toward the second position, the short arm 68 continues to contact the movable member 34 and is slideable upon a top surface of the movable member 34 until the actuator 40 reaches the secured second position and/or until the short arm 68 comes to rest upon a lip 70 of the movable member 34. The mat and towel are now secured within the clip 20, specifically between the movable member 34 and a top surface of the bottom member 24. The over center aspect of the clip 20 along with the position of the short arm 68 on the lip 70 bias the clip 20 to the second position even during use of the clip 20 by an individual during exercise. In order to reverse the process and go from the second position to the first position, the frictional force and the upward force created by the movable portion 34 must be overcome. Such force is overcome by the force generated by an individual using the clip 20.

In the preferred embodiment, the actuator 40 is made of a thermoplastic and the frame is made of steel. The top surface 82 or bottom surface 80 of the actuator is meant to accommodate a logo or identifying mark to assist the user of the clip 20 in recognizing his or her clip.

Figure 7:
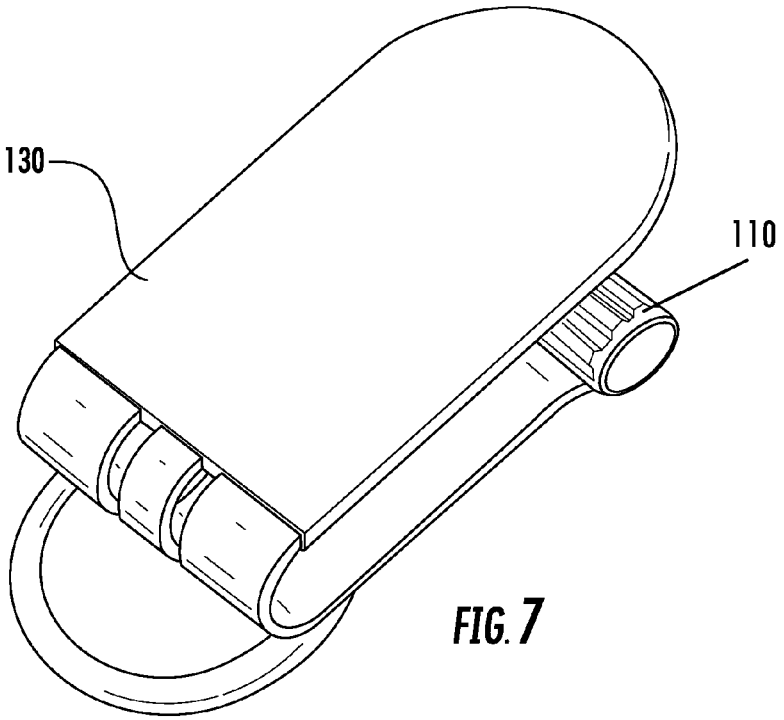
FIG. 7 is perspective view of the invention showing a molded sleeve.
Figure 8:
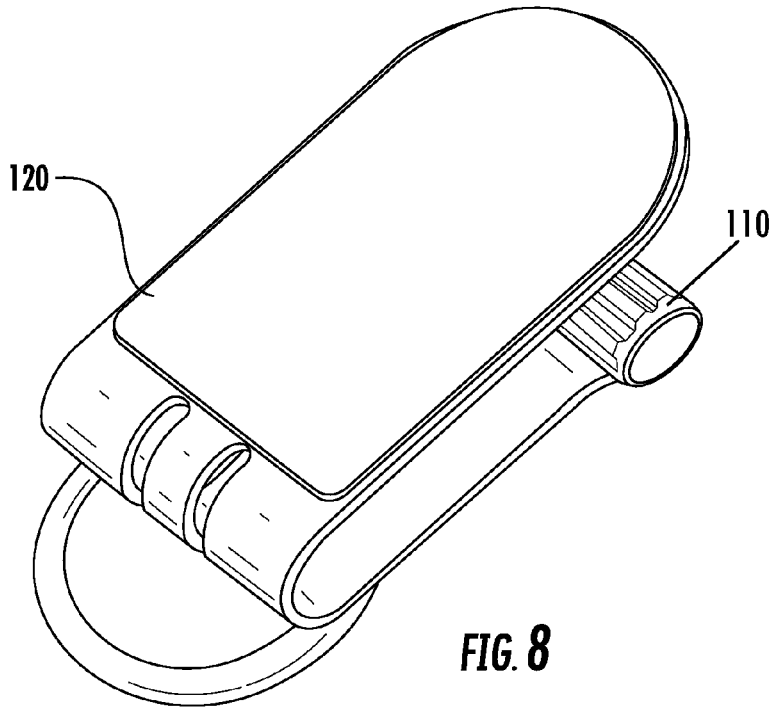
FIG. 8 is a perspective view of the invention showing a rubber pad.

FIGS. 7 and 8 show several options for the clip 20. Side caps 110 can be attached to the device 20 such that the rods 42 are hidden under the caps 110. The caps 110 can also be used to cover portions of the arms 30 and 32 for aesthetic purposes and to help prevent wear. Furthermore, the caps 110 can be shaped such that they reduce injury if a user comes into contact with the clip 20 during use. Additionally, a rubber pad 120 can be used on the bottom of the clip 20 to provide cushion and to make the device less likely to slip while in use. A molded sleeve 130 can be utilized for aesthetic purposes.

Having thus described the invention in connection with the several embodiments thereof, it will be evident to those skilled in the art that various revisions can be made to the several embodiments described herein with out departing from the spirit and scope of the invention. It is my intention, however, that all such revisions and modifications that are evident to those skilled in the art will be included with in the scope of the following claims. Any elements of any embodiments disclosed herein can be used in combination with any elements of other embodiments disclosed herein in any manner to create different embodiments.

What is claimed is:

1. A clip for securing a towel to a mat, comprising:
an actuator;
the actuator having a first end and a second end;
the actuator connected to a frame;
the frame having a top member and a bottom member;
the top member spaced a distance from the bottom member;
the clip having a first position and a second position;
the distance is greater at the first position than the second position, wherein the towel and the mat can be secured in the clip at the second position;
a pad sized to correspond to the shape of the bottom member and provided on the bottom member;
the frame is a spring steel; and
the frame is connected to the actuator between the first end and the second end.

2. The clip of claim 1, wherein:
the actuator is pivotally attached to the frame.

3. The clip of claim 2, wherein:
the actuator is generally L-shaped whereby the actuator is moved toward the second position, the actuator crosses over a center of compression of the spring steel wherein once over center the spring steel exerts a pressure on the mat and towel.

4. The clip of claim 3, wherein:
the first end of the actuator exerts the pressure on the mat and towel at the second position.

5. The clip of claim 4, wherein:
the top member comprises a plurality of arms;
the top member further comprises a movable portion of the spring steel.

6. The clip of claim 5, wherein:
the plurality of arms comprises a first arm and a second arm;
the first arm and second arm connected to the actuator.

7. The clip of claim 6, wherein:
the actuator comprises a pair of opposing rods;
each of the opposing rods held by one of the first arm and second arm.

8. The clip of claim 7, wherein:
the actuator is rotatable around an axis of the pair of opposing rods;
the second end of the actuator exerts a pressure on the movable portion of the spring steel as the actuator is moved from the first position to the second position.

9. The clip of claim 8, wherein:
the movable portion of the spring steel comprises a lip;
the second end of the actuator engaged with the lip when the actuator is in the second position;
whereby a force biases the actuator in the second position;
the force must be overcome for the actuator to go from the second position to the first position.

10. A clip for a yoga mat, comprising:
a frame;
an actuator;
the actuator pivotally attached to the frame;
the frame having a top member and a bottom member;
the top member comprising a plurality of arms;
at least one of the plurality of arms bendable towards the bottom member;
the actuator having a first position and a second position;
whereby the actuator can be selectively moved between the first position and second position and any other position between the first position and second position;
the actuator crosses over a center of compression of the frame whereby once the actuator is over the center, the actuator exerts a pressure on at least one of the plurality of arms which thereby exerts a pressure on the yoga mat;
the actuator in the second position is biased toward remaining in the second position by a force;
whereby the force must be overcome for the actuator to go from the second position to the first position; and
a pad sized to correspond to the shape of the bottom member and provided on the bottom member.

11. The clip of claim 10, wherein:
the actuator is generally L-shaped.

12. The clip of claim 11, wherein:
the actuator comprises a pair of opposing rods.

13. The clip of claim 12, wherein:
the actuator is rotatable around an axis of the pair of opposing rods.

14. A clip for a yoga mat, comprising:
a frame;
an actuator;
the actuator pivotally attached to the frame;
the frame having a top member and a bottom member;
the top member comprising a plurality of arms;
at least one of the plurality of arms bendable towards the bottom member;
the actuator having a first position and a second position;
whereby the actuator can be selectively moved between the first position and second position and any other position between the first position and second position;
the actuator crosses over a center of compression of the frame whereby once the actuator is over the center, the actuator exerts a pressure on at least one of the plurality of arms which thereby exerts a pressure on the yoga mat;
the actuator in the second position is biased toward remaining in the second position by a force;
whereby the force must be overcome for the actuator to go from the second position to the first position;
the plurality of arms comprises a first arm and a second arm;
the first arm and second arm connected to the actuator;
the actuator comprises a pair of opposing rods;
each of the opposing rods held by one of the first arm and second arm;
a pad on the frame whereby potential movement of the clip on a ground surface is decreased;
wherein the pad is not mountable to an object other than the clip;
a cap covering at least a portion of the first arm and second arm; and
the cap covering at least one of the pair of opposing rods.

* * * * *